United States Patent [19]

Leininger et al.

[11] Patent Number: 4,512,091

[45] Date of Patent: Apr. 23, 1985

[54] SNOW PLOW SCOOP

[76] Inventors: Glenn Leininger, c/o George Spector, 3615 Woolworth Bldg., 233 Broadway; George Spector, 3615 Woolworth Bldg., 233 Broadway, both of, New York, N.Y. 10007

[21] Appl. No.: 459,363

[22] Filed: Jan. 19, 1983

[51] Int. Cl.[3] ..... E01H 5/02

[52] U.S. Cl. ..... 37/278; 37/285; 172/358; 172/365; 294/57

[58] Field of Search ..... 37/272, 265, 278, 284, 37/273, 285; 172/354, 358, 365; 294/54.4, 57

[56] References Cited

U.S. PATENT DOCUMENTS

| | | | |
|---|---|---|---|
| 157,078 | 11/1874 | Parker et al. | 37/278 X |
| 540,284 | 6/1895 | Tremper et al. | 37/272 |
| 1,319,972 | 10/1919 | Shun | 37/273 |
| 1,672,490 | 6/1928 | Herchert | 37/278 X |
| 1,728,761 | 9/1929 | Hojnowski | 37/272 X |
| 2,460,560 | 2/1949 | Williams | 37/278 |
| 2,811,792 | 11/1957 | Cork, Jr. | 37/284 |
| 3,248,811 | 5/1966 | Pravednekow | 37/278 X |
| 3,664,042 | 5/1972 | Duran | 37/278 |

FOREIGN PATENT DOCUMENTS

| | | | |
|---|---|---|---|
| 158957 | 5/1957 | Sweden | 294/57 |

*Primary Examiner*—Edgar S. Burr
*Assistant Examiner*—Moshe I. Cohen

[57] ABSTRACT

A wheeled snow plow is provided and consists of a tubular frame having a laterally spaced pair of side portions, a rear portion and a V-shaped front portion to form a generally rectangular configuration, three wheel assemblies, one wheel assembly mounted to bottom center of the V-shaped front portion and each of the other two wheel assemblies mounted to bottom center of a respective side portion of the frame, a U-shaped handle connected pivotally to top center of the side portions of the frame so that the U-shaped handle will sit at a vertical angle with respect to the frame when in use, a V-shaped plow blade connected pivotally to the side portions of the frame so that the V-shaped plow blade will face frontwardly and be horizontal to the frame and a device for height adjusting the V-shaped plow blade with respect to the frame allowing for passage over rough and uneven terrain.

3 Claims, 3 Drawing Figures

SNOW PLOW SCOOP

BACKGROUND OF THE INVENTION

The instant invention relates generally to snow removing devices and more specifically it relates to a wheeled snow plow.

When a person removes snow from their sidewalks in winter they either shovel or use a snow blower. In the first case shoveling is time consuming and requires a lot of strength to do. In the second case the snow blower can be quite costly and have a bulky engine to start and maintain.

SUMMARY OF THE INVENTION

A principle object of the present invention is to provide a wheeled snow plow that will remove snow from sidewalks with little effort.

Another object is to provide a wheeled snow plow that can be operated by nearly anyone and is easy to use.

An additional object is to provide a wheeled snow plow that has a folding handle for compact storage on wall of garage.

A further object is to provide a wheeled snow plow that has very little to wear out and replace so that it will last for years.

A still further object is to provide a wheeled snow plow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
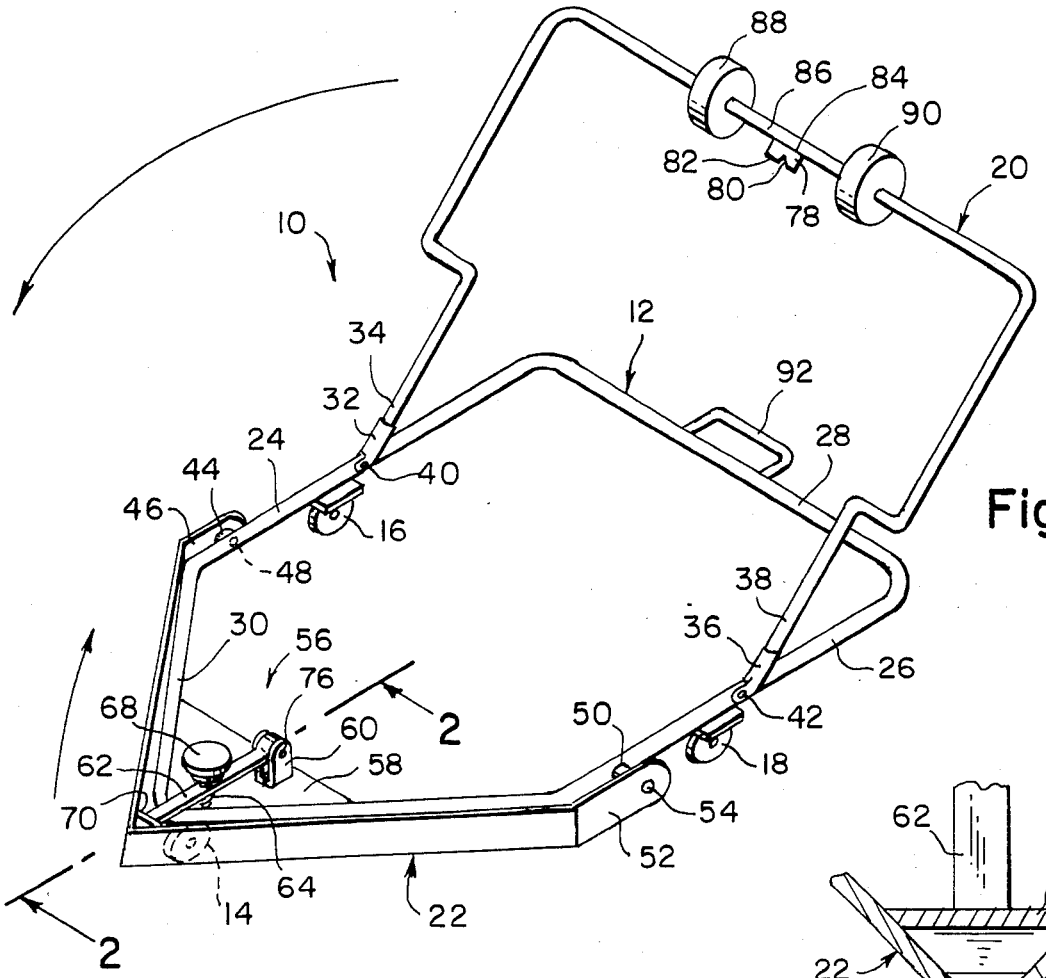
FIG. 1 is a perspective view of the invention.

Turning now descriptively to the drawings, in which similar reference characters denote similar elements throughout the several views, FIG. 1 illustrates a wheeled snow plow 10. The plow 10 consists of a tubular frame 12, three wheel assemblies 14, 16 and 18, a U-shaped handle 20 and a V-shaped plow blade 22.

The tubular frame 12 has a laterally spaced pair of side portions 24 and 26, a rear portion 28 and a V-shaped front portion 30 to form a generally rectangular configuration.

Wheel assembly 14 is mounted to bottom center of the V-shaped front portion 30. The wheel assembly 16 is mounted to bottom center of side portion 24 while the wheel assembly 18 is mounted to bottom center of side portion 26.

The U-shaped handle 20 is pivotally connected to top center of the side portions 24 and 26 of the frame 12 so that the U-shaped handle 20 will sit at a vertical angle with respect to the frame 12 when in use. A hinge stop member 32 is affixed to free end 34 of the U-shaped handle 20 and a hinge stop member 36 is affixed to free end 38 of the U-shaped handle 20. Pivot pin 40 is placed through the hinge stop member 32 and the side portion 24 of the frame 12 while pivot pin 42 is placed through the hinge stop member 38 and the side portion 26 of the frame 12.

The V-shaped plow blade 22 is pivotally connected to the side portions 24 and 26 of the frame 12 so that the V-shaped plow blade 22 will face frontwardly and be horizontal to the frame 12. A spacer 44 having an aperture is placed between end 46 of the V-shaped plow blade 22 and side of front end of the side portion 24 of the frame 12 with a pivot pin 48 placed therethrough. A spacer 50 having an aperture is placed between other end 52 of the V-shaped plow blade 22 and side of front end of the side portion 26 of the frame 12 with a pivot pin 54 placed therethrough.

Figure 2:
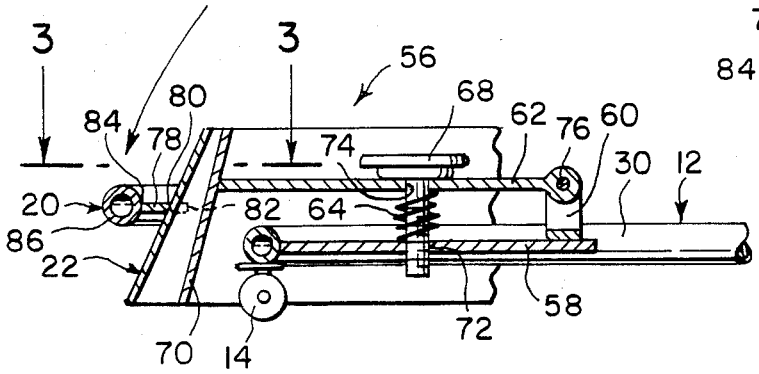
FIG. 2 is a cross sectional view taken along line 2—2 in FIG. 1.

A device 56 for height adjusting the V-shaped plow blade 22 with respect to the frame 12 is best shown in FIG. 2 and allows for passage over rough and uneven terrain. The device 56 consists of a rearwardly extending triangular plate 58, an upright U-shaped member 60, a horizontal arm member 62, a spring 64, an adjustment screw 68 and a plow plate 70.

The triangular plate 58 has a central threaded aperture 72 affixed between the V-shaped front portion 30 of the frame 12 with the upright U-shaped member 60 affixed to rear center of the triangular plate 58.

The horizontal arm member 62 has a transverse aperture 74 and is pivotally affixed 76 at rear end to the upright U-shaped member 60. The adjustment screw 68 is placed through the aperture 74 in the horizontal arm member 62 through the spring 64 and threaded into the threaded aperture 72 in the triangular plate 58.

The plow plate 70 is affixed at an angular vertical position between the V-shaped plow blade 22. The plow plate 70 engages front end of the horizontal arm member 62 so that by tightening the adjustment screw 68 the V-shaped plow blade 22 will move up while the V-shaped plow blade 22 is prevented from traveling downwards when the wheel snow plow 10 is in use.

Figure 3:
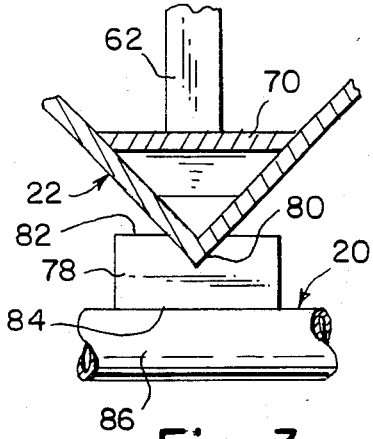
FIG. 3 is a cross sectional view taken along line 3—3 in FIG. 2.

As best seen in FIG. 3 the wheeled snow plow 10 contains a plow engaging plate 78 having a V-cut out 80 on one edge 82 and affixed at the other end 84 inwardly from the center 86 of the U-shaped handle 20 so that when the U-shaped handle 20 is pivoted to a closed position for storage the plow engaging plate 78 will engage the pointed edge of the V-shaped plow blade 22 preventing the V-shaped plow blade 22 from moving.

Hand grips 88 and 90 are placed onto the center 86 of the U-shaped handle 20 for better holding of the U-shaped handle 20.

A carry handle 92 is affixed to center of the rear portion 28 outwardly from the frame 12 so that a person can carry the wheeled snow plow 10 when the U-shaped handle 20 is pivoted to a closed position and not in use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wheeled snow plow which comprises:

(a) a tubular frame having a laterally spaced pair of side portions, a rear portion and a V-shaped front portion;

(b) three wheel assemblies, one wheel assembly mounted to the bottom center of the V-shaped front portion and each of the other two wheel assemblies mounted to the bottom center of a respective side portion of the frame;

(c) a U-shaped handle with a free end and a pivotal end;

(d) means for connecting said pivotal end pivotally to the top center of the side portions of the frame so that the U-shaped handle will sit at a vertical angle with respect to the frame when it is in use and will pivot forwardly beyond said front portion of said frame when pivoted to a closed position when not in use;

(e) a V-shaped plow blade;

(f) means for connecting the V-shaped snow plow blade pivotally to the side portions of the frame so that the V-shaped plow blade will face frontwardly, be spaced from and circumscribe said V-shaped front portion;

(g) means for height adjusting the V-shaped plow blade with respect to the frame allowing for passage over rough and uneven terrain; the means for connecting the U-shaped handle pivotally to the top center of the side portions of the frame comprises:

(h) a pair of hinge stop members each hinge stop member affixed to the free end of the U-shaped handle, and (i) a pair of pivot pins each pivot pin placed through one of the hinge stop members and one of the side portions of the frame; the means for connecting the V-shaped plow blade pivotally to the side portions of the frame comprises:

(j) a pair of spacers, each spacer having an aperture placed between one end of the V-shaped plow blade and the side of the front end of one of the side portions of the frame; and (k) a pair of pivot pins, each pivot pin placed through one end of the V-shaped plow blade, the aperture of the spacer and into the front end of one of the side portions of the frame.

2. A wheeled snow plow as recited in claim 1, wherein the means for height adjusting the V-shaped plow blade with respect to the frame comprises:

(a) a rearwardly extending triangular plate having a central threaded aperture affixed within the V-shaped front portion of the frame;

(b) an upright U-shaped member affixed to the rear center of the triangular plate;

(c) a horizontal arm member having a transverse aperture pivotally affixed at the rear end to the upright U-shaped member;

(d) a spring;

(e) an adjustment screw placed through the aperture in the horizontal arm member through the spring and threaded into the threaded aperture in the triangular plate; and (f) a flow plate affixed at an angular vertical portion between the V-shaped plow blade, the plow plate engages the front end of the horizontal arm member so that by tightening the adjustment screw the V-shaped plow blade will move up while the V-shaped plow blade is prevented from moving downward when the wheeled snow plow is in use.

3. A wheeled snow plow as recited in claim 2, that further comprises a plow engaging plate having a V-shaped cut on one edge and affixed at the other end inwardly from the center of the U-shaped handle so that when the U-shaped handle is pivoted to a closed position for storage, the plow engaging plate will engage the pointed edge of the V-shaped plow blade preventing the V-shaped plow blade from moving; at least one hand grip placed onto the center of the U-shaped handle for better holding of the U-shaped handle; a carry handle affixed to the center of the rear portion outwardly from the frame so that a person can carry the wheeled snow plow when the U-shaped handle is pivoted to a closed position and not in use.

* * * * *